US010460545B2

(12) United States Patent
Evans et al.

(10) Patent No.: US 10,460,545 B2
(45) Date of Patent: Oct. 29, 2019

(54) SYSTEM AND METHOD FOR SECURE ENTRY

(71) Applicant: Chris Evans, Waterloo (CA)

(72) Inventors: Chris Evans, Waterloo (CA); Edward Stager, Moorefield (CA)

( * ) Notice: Subject to any disclaimer, the term of this patent is extended or adjusted under 35 U.S.C. 154(b) by 0 days.

(21) Appl. No.: 15/502,104

(22) PCT Filed: Aug. 21, 2015

(86) PCT No.: PCT/CA2015/050800
§ 371 (c)(1),
(2) Date: Feb. 6, 2017

(87) PCT Pub. No.: WO2016/026049
PCT Pub. Date: Feb. 25, 2016

(65) Prior Publication Data

US 2017/0228954 A1 Aug. 10, 2017

Related U.S. Application Data

(60) Provisional application No. 62/040,159, filed on Aug. 21, 2014.

(51) Int. Cl.
*G07C 9/00* (2006.01)
*G08B 13/24* (2006.01)
(Continued)

(52) U.S. Cl.
CPC ..... *G07C 9/00896* (2013.01); *E05B 19/0005* (2013.01); *E05B 39/005* (2013.01);
(Continued)

(58) Field of Classification Search
CPC ..... G07C 9/00571; G07C 2009/00936; G07C 9/0069; G07C 9/00896; G08B 21/24;
(Continued)

(56) References Cited

U.S. PATENT DOCUMENTS 4,766,746 A 8/1988 Henderson et al.
4,887,292 A * 12/1989 Barrett ..... G07C 1/32 340/5.23

(Continued)

*Primary Examiner* — Yong Hang Jiang
(74) *Attorney, Agent, or Firm* — Cherskov Flaynik & Gurda, LLC

(57) ABSTRACT

There is provided a system and method for secure entry to a property or building. One aspect includes an apparatus having a housing and alarm means for triggering a timed alarm upon removal of a receptacle key from the housing. Locking means is included for locking the housing. Another aspect includes a removable media containing a list of cylinder codes. At least a portion of the list of cylinder codes are transferred to a receptacle key within the housing. Another aspect involves a system having a secure container with locking means for locking a housing. The system includes at least one locking receptacle that is unlocked with the receptacle key. Also provided is a method comprising the steps of retrieving a receptacle key from a secure container, triggering a timed alarm for return of the receptacle key and accessing a locking receptacle with the receptacle key.

25 Claims, 16 Drawing Sheets

(51) Int. Cl.

| | |
|---|---|
| ***E05B 39/00*** | (2006.01) |
| ***E05G 1/04*** | (2006.01) |
| ***E05B 19/00*** | (2006.01) |
| ***G08B 21/24*** | (2006.01) |
| ***E05G 1/10*** | (2006.01) |
| ***G08B 13/14*** | (2006.01) |

(52) U.S. Cl.
CPC ..... *E05G 1/04* (2013.01); *E05G 1/10* (2013.01); *G07C 9/0069* (2013.01); *G07C 9/00571* (2013.01); *G08B 13/149* (2013.01); *G08B 13/2402* (2013.01); *G08B 21/24* (2013.01); *G07C 2009/00936* (2013.01)

(58) Field of Classification Search
CPC .... G08B 13/149; G08B 13/2402; E05G 1/04; E05G 1/10; E05B 19/0005; E05B 39/005; E05B 77/22; E05B 77/44
USPC ..... 340/5.28, 5.7, 5.73
See application file for complete search history.

(56) References Cited

U.S. PATENT DOCUMENTS 5,648,763 A * 7/1997 Long ..... G07C 5/008 340/5.21
5,905,446 A * 5/1999 Benore ..... G07C 9/00103 109/53
7,009,489 B2 3/2006 Fisher
7,333,016 B2 * 2/2008 Ancel ..... B65G 69/2882 235/385
2002/0180582 A1 * 12/2002 Nielsen ..... G07C 9/00103 340/5.6
2003/0025590 A1 * 2/2003 Gokcebay ..... G06Q 40/04 340/5.73
2003/0231103 A1 * 12/2003 Fisher ..... G07C 9/00103 340/5.73
2004/0076544 A1 * 4/2004 Dao ..... A47G 29/1207 422/62
2005/0178174 A1 * 8/2005 Ely ..... E05B 65/006 70/164
2005/0206499 A1 9/2005 Fisher
2007/0090921 A1 * 4/2007 Fisher ..... G07C 9/00103 340/5.73
2007/0144812 A1 * 6/2007 Stewart ..... B60K 28/063 180/272
2008/0246587 A1 10/2008 Fisher
2009/0153291 A1 * 6/2009 Larson ..... E05B 19/0005 340/5.33
2011/0254661 A1 * 10/2011 Fawcett ..... G08B 13/1445 340/5.61
2012/0011367 A1 * 1/2012 Denison ..... G07C 9/00571 713/170
2013/0027177 A1 * 1/2013 Denison ..... G07C 9/00571 340/5.23
2013/0187756 A1 * 7/2013 Fisher ..... G07C 9/00571 340/5.61
2014/0152421 A1 * 6/2014 Cazanas ..... G07C 9/00309 340/5.32
2014/0330788 A1 * 11/2014 Um ..... H05K 7/1498 707/661
2015/0020085 A1 * 1/2015 Wilk ..... E05B 73/0023 720/733
2017/0069148 A1 * 3/2017 Gilbertson ..... G07C 9/00087

* cited by examiner

SYSTEM AND METHOD FOR SECURE ENTRY

TECHNICAL FIELD

The present disclosure relates generally to secure entry to a property. More particularly, the present disclosure relates to a system and method for secure entry to a property using a locking receptacle.

BACKGROUND

Locking receptacles, sometimes referred to as 'lock boxes', are typically containers, such as boxes, cylinders, or the like, that act as a secure access repository for valuable articles. Locking receptacles may be sealed with a secure door or access point. The secure door may provide secure access through the use of a lock; for example, a pin tumbler lock, padlock, keypad lock, radio-frequency identification (RFID) lock, magnetic lock, or the like.

A conventional function of locking receptacles is as depositories of keys for a property, building, residence, or the like. In some instances, the locking receptacle may be mounted to the exterior of the property. The keys to enter the property may be stored in the locking receptacle. Thus, a person who gains access to the locking receptacle can receive the key to enter the property.

Having a locking receptacle mounted to the exterior of a property may be advantageous where access is required for multiple properties, but a single or unified key (or other device to operate the locks) is desired for entry to the multiple properties. In an example, a real estate agency may have multiple properties for sale. Rather than having to carry keys for each property, each property may have a locking receptacle mounted to the exterior of the property. The locking receptacle may include a property key inside for entering the property. Each locking receptacle could be accessed via a keypad or tumbler code by receiving a secure code that is transmitted via telephone or text to the real estate agent upon arrival at the premises.

US Publication No. 20090153291 provides an example of a real estate security system wherein access to a lockbox, that houses a key, causes automatic notification to an owner/occupant associated with the property. Such a communication can be used to alert the owner/occupant that a real estate showing is started or completed, that a friend or family member arrived home safely, that a property management accessed the house, or that emergency personnel accessed the house. The lockbox can include additional features that cause notification to the owner, such as automated sensing of tampering with the lockbox, or depressing a button on the lockbox to generate a signal to the owner/occupant of the property.

For years firefighters or other emergency personnel have been arriving at various buildings in response to an emergency call with an urgent need to access the building. Current commercial and residential lock box programs in place across Canada and the US are called Supra™ and Knox Box™. Both utilize a specially coded mechanical key that is kept inside the cab of each fire truck using various security methods. Each mechanical key opens up a roughly 4"×3"×3" metal lock box attached to the exterior of the building. The box houses specific keys to that building including a possible master key. These programs were set up to aid firefighters with gaining immediate access in the event of an emergency.

There are several problems with the current system. Quite often, paramedics and police arrive first and have to wait for fire truck to arrive before they can enter, which wastes precious time. The lock boxes are out in the open and not attached securely enough to the building structure; therefore theft and unlawful access are possible. The boxes are also bulky and unattractive, which is an issue for home owners. There is a high possibility for loss of the mechanical key through misplacement or loss on site. There are no current methods for tracking accessibility of the storage box, tracking accountability of personnel who access the lock box and finding lost keys from the storage box.

If a lockbox is compromised resulting in loss of the master key therein, there may be a huge financial loss to that building owner as well as a loss of security. Furthermore, insurance rates may increase as a result of the lock box due to the potential liability and high cost to re-key an entire building if the current lock box is maliciously compromised resulting in loss of a master key. If the department mechanical key is lost, the liability may be even larger since not only would each face plate of Supra have to be replaced and each Knox Box re-keyed, but all building locks/apartments with said lock boxes would have to be completely re-keyed. In the case of either a lost department mechanical key or a compromised lockbox, temporary security personnel would be required at the main doors of each affected building to verify those coming and going until the process was complete.

Other sectors also require a secure and accountable locking receptacle and container. For example, paramedics need a more secure place to temporarily store toxic medication. Police officers are often called to assist in emergency calls and also need to gain entry. Quick access to a building should be available to the first Emergency Medical Services (EMS) to arrive. There is a need for a more secure place to store department keys/cards. Accountability issues are on the rise in every sector and infallible security is being demanded globally.

The conventional practice of having a key-accessible locking receptacle mounted on the exterior of a property presents liability and security concerns. As such, there is a need for an improved system and method for secure and accountable entry to a building using a locking receptacle.

Furthermore, there is a need to provide secure emergency access to a property for emergency services. In particular, a property owner requires peace of mind that an external lockbox mounted on the exterior of the property is tamper-proof and, furthermore, that any means for accessing the lockbox is secure and accountable. In the event of an emergency unfolding inside the property, such as a fire or health crisis, with the property locked and no one available to open it, the emergency services need a prompt manner of accessing a secure, tamper-proof lockbox without having to break down the entryway of the property. Typically, it would be impractical for the emergency services to carry entry keys for all the properties in its service area.

SUMMARY

It is an object of the present disclosure to obviate or mitigate at least one disadvantage of conventional secure entry systems and methods.

In accordance with one aspect there is provided, an apparatus comprising a housing; alarm means configured to trigger a timed alarm upon removal of a receptacle key from the housing; and locking means for locking the housing.

In accordance with another aspect there is provided an apparatus wherein the locking means includes a keypad and the locking means is unlocked upon input of an access code on the keypad.

In accordance with another aspect there is provided an apparatus wherein upon input of the access code, various parameters are recorded.

In accordance with another aspect there is provided an apparatus wherein the various parameters are selected from the group consisting of a user ID, date of the input, time of the input, GPS location and combinations thereof.

In accordance with another aspect there is provided an apparatus wherein upon input of the access code, various parameters are transmitted to a central location.

In accordance with another aspect there is provided an apparatus further comprising a removable media containing a list of cylinder codes.

In accordance with another aspect there is provided an apparatus wherein at least a portion of the list of cylinder codes are transferred to the receptacle key within the housing.

In accordance with another aspect there is provided an apparatus wherein the list of cylinder codes are geographically restricted.

In accordance with another aspect there is provided an apparatus wherein the alarm means measures an amount of time that the receptacle key has been removed.

In accordance with another aspect there is provided an apparatus wherein the timed alarm includes a notification selected from the group consisting of a flashing light, an intermittent buzzer, a constant buzzer, a message to a central office, and combinations thereof.

In accordance with another aspect there is provided an apparatus wherein the timed alarm activates the notification after an elapsed time during which the receptacle key has been removed from the housing.

In accordance with another aspect there is provided an apparatus wherein the alarm means deactivates the receptacle key after a further elapsed time during which the receptacle key has been removed from the housing.

In accordance with another aspect there is provided an apparatus further comprising tracking means for locating the receptacle key outside of the housing.

In accordance with another aspect there is provided an apparatus further comprising mounting means for mounting on a mobile platform.

In accordance with another aspect there is provided an apparatus further comprising mounting means for mounting on a vehicle.

In accordance with another aspect there is provided an apparatus further comprising a power source.

In accordance with another aspect there is provided a system comprising: a secure container having a locking means for locking a housing; alarm means configured to trigger a timed alarm upon removal of a receptacle key from the housing; and at least one locking receptacle that is unlocked with the receptacle key.

In accordance with another aspect there is provided a system further comprising a removable media containing a list of cylinder codes.

In accordance with another aspect there is provided a system wherein the secure container comprises a receiver for the removable media.

In accordance with another aspect there is provided a system wherein at least a portion of the list of cylinder codes are transferred to the receptacle key within the housing.

In accordance with another aspect there is provided a system wherein the list of cylinder codes are restricted to enable access to one or more of the at least one locking receptacles within a given distance from the receptacle key.

In accordance with another aspect there is provided a system further comprising activation means configured to enable and disable the receptacle key.

In accordance with another aspect there is provided a system wherein the locking receptacle comprises a housing and a locking means, wherein the housing is mounted flush to an external wall of a property.

In accordance with another aspect there is provided a system further comprising mounting means for mounting the secure container on a mobile platform.

In accordance with another aspect there is provided a system further comprising mounting means for mounting the secure container on a vehicle.

In accordance with another aspect there is provided a system wherein the mounting means includes power means for connecting the secure container to an electrical power source of the vehicle.

In accordance with another aspect there is provided a system further comprising a power source.

In accordance with another aspect there is provided a system wherein the locking means includes a keypad and the locking means is unlocked upon input of an access code on the keypad.

In accordance with another aspect there is provided a system wherein upon input of the access code, various parameters are recorded.

In accordance with another aspect there is provided a system wherein the various parameters are selected from the group consisting of a user ID, date of the input, time of the input, GPS location and combinations thereof.

In accordance with another aspect there is provided a system wherein upon input of an access code, various parameters are transmitted to a central location.

In accordance with another aspect there is provided a system wherein the central location authorizes the various parameters and activates the receptacle key.

In accordance with another aspect there is provided a method comprising: retrieving a receptacle key from a secure container; triggering a timed alarm for return of the receptacle key; and accessing a locking receptacle with the receptacle key.

In accordance with another aspect there is provided a method wherein the step of retrieving the receptacle key comprises inputting an access code to unlock the secure container.

In accordance with another aspect there is provided a method further comprising the step of recording various parameters selected from the group consisting of a user ID, date of the input, time of the input, GPS location and combinations thereof.

In accordance with another aspect there is provided a method further comprising the step of transmitting the various parameters to a central location.

In accordance with another aspect there is provided a method further comprising the step of transferring at least a portion of a list of cylinder codes to the receptacle key within the housing.

In accordance with another aspect there is provided a method wherein the list of cylinder codes are geographically restricted.

In accordance with another aspect there is provided a method wherein the step of triggering a timed alarm comprises the step of measuring an amount of time that the receptacle key has been removed.

In accordance with another aspect there is provided a method further comprising the step of activating a notification after an elapsed time during which the receptacle key has been removed from the housing.

In accordance with another aspect there is provided a method wherein the notification is selected from the group consisting of a flashing light, an intermittent buzzer, a constant buzzer, a message to a central office, and combinations thereof.

In accordance with another aspect there is provided a method further comprising the step of deactivating the receptacle key after a further elapsed time during which the receptacle key has been removed from the housing.

In accordance with another aspect there is provided a method further comprising the step of tracking the receptacle key outside of the housing.

In accordance with another aspect there is provided an apparatus comprising: a housing; locking means for locking the housing; a removable media containing a list of cylinder codes; wherein at least a portion of the list of cylinder codes are transferred to a receptacle key within the housing.

The present secure entry system provides a secure and reliable source to secure all EMS and non-emergency keys/cards/medication etc. The system is accountable and could eliminate liability involved in lost Supra or Knox Box keys.

The present secure entry system is capable of tracking lost keys and providing reminders in order to avert a lost key. The present secure system can be used for paramedics who need a more secure place to temporarily store toxic medication. Similarly, emergency response units such as police officers and firefighters are able to use the present secure entry system to gain quick access to a building, regardless of the first emergency response team to arrive on the scene. The present secure entry system can be used for storage of keys and cards in order to increase security and provide accountability.

In one embodiment, the present secure entry system can securely house all current department keys/cards/medications and can house and charge an electronic key system that communicates with installed locks at residential/commercial buildings while in motion. The system can alert personnel that keys/cards are not safe and secure by way of a flashing light and/or audible sound. A flashing light on the face of the secure container in one embodiment indicates removal of all department keys. A further audible alarm issues in a further embodiment if the keys are not replaced back into box after set time. Such mechanisms assist in preventing the user from leaving the scene without the department keys.

In another embodiment, a GPS signal can be used to activate an electronic key. The system can accept a download of newly added codes for locks and to transfer the new codes to an external source (e.g. a department computer where they will be added to the main server site).

In a further embodiment, the electronic key includes a set timer to disable its use after a set amount of time. Thus, if the electronic key is lost/misplaced after removal from the secure container, the electronic key will become disabled and useless, thereby protecting the key from any malicious use. This system also eliminates replacement cost if the key is lost or misplaced because the key becomes inactive and disabled after a set time. Once the key is returned to the charger in the secure container, it can be activated again.

In another embodiment, the secure entry system includes a cylinder shaped lock box that is recessed into the exterior of structure. Obtaining the contents of the cylinder maliciously would involve destroying the outer brick, stone, framework etc. In this embodiment, the cylinder can be mounted securely flush to an exterior wall.

Use of the present system has an added benefit of potentially lower insurance costs through various insurance companies as a result of the secure and accountable entry system of the present invention.

The present secure entry system in another aspect is able to provide multiple individual entry codes so that each emergency response attendant with approved access to their secure container could have their own access code to the secure container, thus creating accountability respecting the last person to access the container.

Examples of various operating principles and advantages of the secure entry system described herein include:

- Decoupling of key and lock
- Ability to access any number of locks (e.g. 5,000) with a single key
- Ability to access a lock with any key
- Key works for limited time
- Ability to replace damaged keys without affecting locks
- Access traceability
- Location and time of day reporting
- Detection of secure container access
- Detection of key removal and replacement
- Real time position updates (GPS)
- Real time remote communication with central office
- Generation and transmission of SMS packets
- Wide operating temperature range
- Simple operation requiring minimal training
- Robust and water resistant
- Audio/Visual user interface Aspects and features of the present disclosure will become apparent to those ordinarily skilled in the art upon review of the following description of specific embodiments in conjunction with the accompanying figures.

BRIEF DESCRIPTION OF THE DRAWINGS

The following description will be better understood with reference to the drawings in which.

DESCRIPTION OF THE PREFERRED EMBODIMENTS

Generally, the present disclosure provides a system and method for secure entry to a property using a locking receptacle that is intended to overcome at least some of the limitations of conventional secure entry practice. The systems and methods described herein allow a user to have one key to achieve entry into multiple properties, while providing a secure and accountable container for such key.

Figure 1:
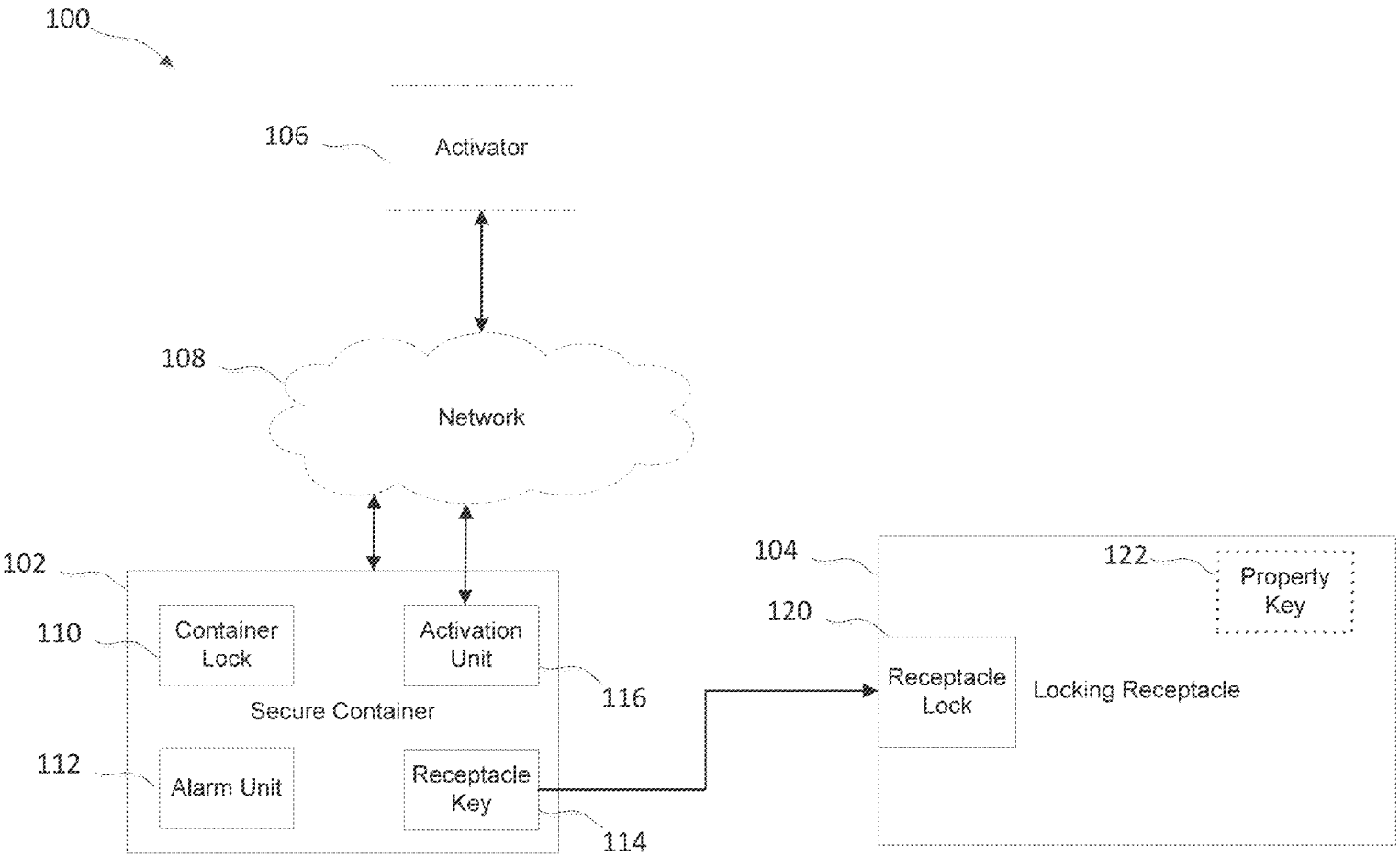
FIG. 1 illustrates a block diagram of an embodiment of a secure entry system.

FIG. 1 illustrates a block diagram of an embodiment of a secure entry system 100. The secure entry system includes a secure container 102, a receptacle key 114 and a locking receptacle 104. In some cases, as will be described, the secure entry system 100 may also include an activator 106 and a network 108. The secure container 102 includes a container lock 110 and an alarm unit 112. In some cases, as will be described, the secure container 102 may also include an activation unit 116. The locking receptacle 104 includes a receptacle lock 120.

The locking receptacle 104 may be used as secure storage for a property key 122. In other cases, the locking receptacle 104 may be used as secure storage for other articles along with, or instead of, the property key 122; for example, storage of an emergency contact sheet, a garage door opener, a parcel, or the like.

Figure 2:
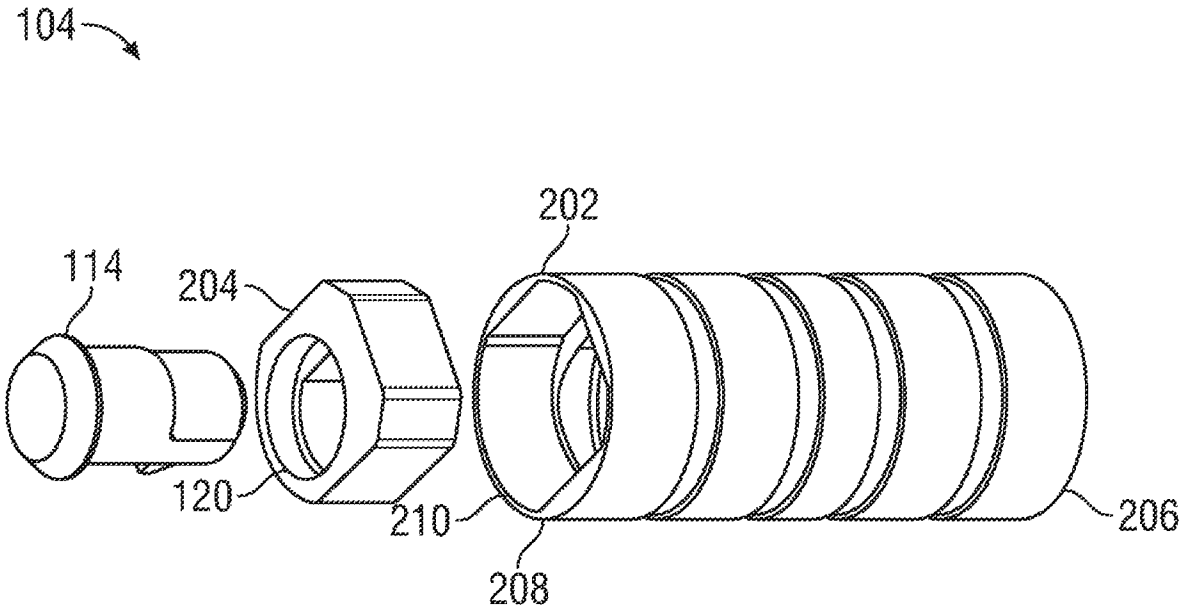
FIG. 2 illustrates a perspective view of one example of a locking receptacle with a corresponding receptacle key.

FIG. 2 illustrates a perspective view of one example of a locking receptacle 104 with a corresponding receptacle key 114. The locking receptacle 104 may include a body 202 and a lid 204. In this example, the body 202 is in a tubular shape that is closed at a lateral end 208 and has an opening 210 starting at a proximate end 208. In some cases, the body 202 may be mounted on, or recessed into, an exterior surface of the property. It is intended that the design of the locking receptacle 104 of FIG. 2 is functional yet minimally aesthetically intrusive by having a relatively small lateral end face. The property key 122 may be stored inside the opening 210 of the locking receptacle 104.

The lid 204 is mounted at the proximate end 208 of the body 202 such that the lid 204 covers the opening 210, or at least does not permit removal of the property key 122 from the opening 210. In further cases, the lid 204 may be integral to the body 202. The receptacle lock 120 is incorporated into the lid 204. The receptacle lock 120 is positioned and configured such that the receptacle key 114 can engage the receptacle lock 120 in order to open the locking receptacle 104. The receptacle lock 120, and the counterpart receptacle key 114, may be, for example, a pin tumbler lock, padlock, keypad lock, radio-frequency identification (RFID) lock, magnetic lock, or the like. The locking receptacle 104 is opened when retrieval of the property key 122 is possible by, for example, removing the lid 204. In some cases, the lid 204 may be connected to the body 202 like a hinged door.

In further cases, the locking receptacle 104 may be any suitable shape as long as the opening 210 can fit a property key 122 and/or storage of certain other articles. The locking receptacle 104 may include further mechanisms for mounting to the exterior of the property; for example, mounting brackets, epoxy, or the like. In some cases, the locking receptacle 104 may be recessed into an exterior surface of the property. Although a circular locking receptacle 104 has been illustrated, it will be understood that the locking receptacle 104 can be any shape or size desired for holding the property key 122, emergency contact sheet, garage door opener, parcel, or the like.

Figure 3:
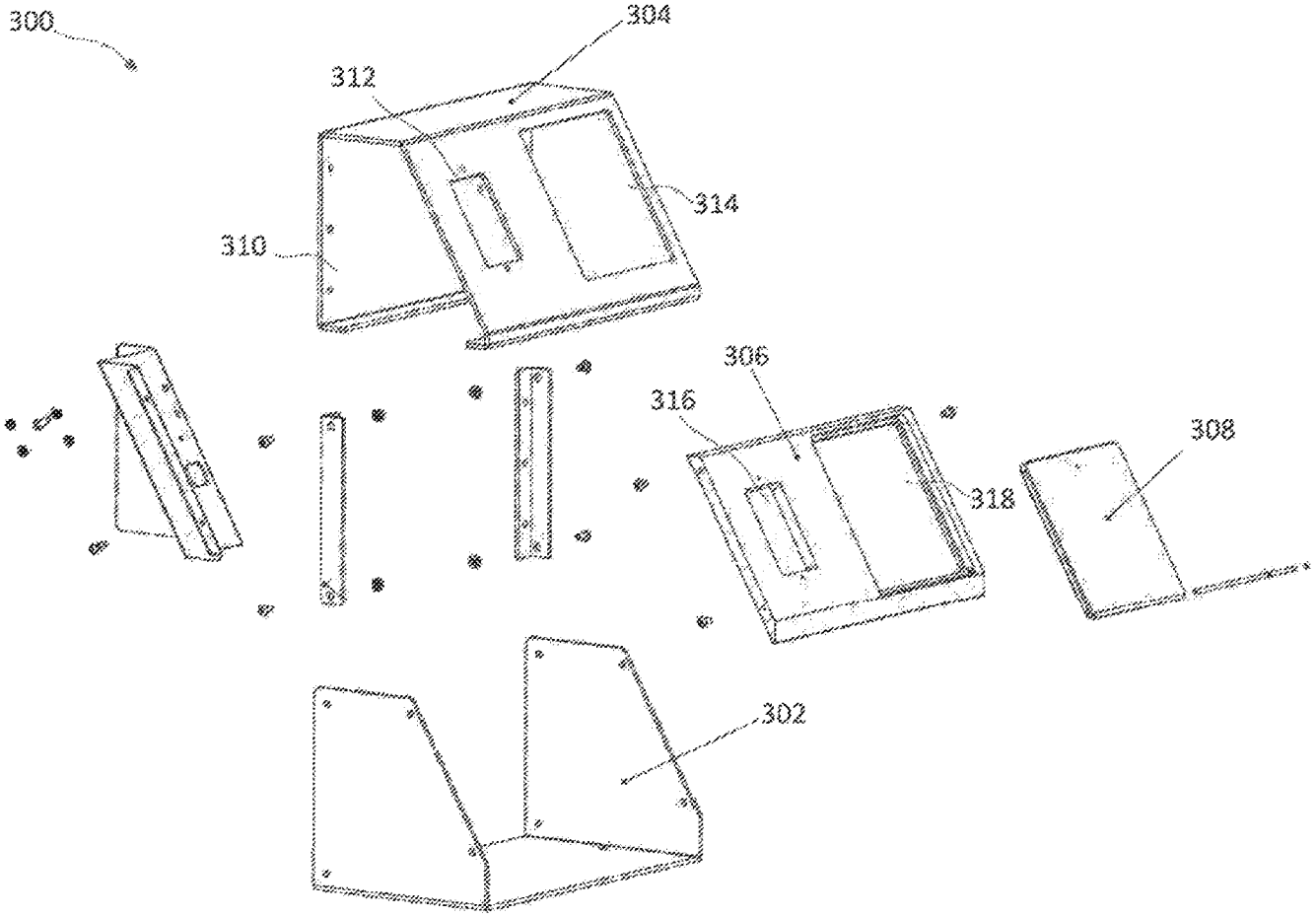
FIG. 3 illustrates an exploded perspective view of an embodiment of a frame for a secure container.

FIG. 3 illustrates an exploded perspective view of an embodiment of a frame 300 for a secure container 102. The frame 300 of the secure container 102 includes a base 302, a cover 304, a faceplate 306 and a door 308. The cover 304 attaches over the base 302 to form an enclosed space 310. The front of the cover 304 includes a first opening 314 and a second opening 312. The faceplate 306 is attached over the front of the cover 304 such that the openings 316, 318 in the face plate 306 coincide with the openings 312, 314 in the cover 304.

The first opening 312 is configured to receive a container lock (described below) and the second opening 314 is configured to receive an access door 308. In other embodiments, there may be only one opening with the lock incorporated into the access door 308. The access door 308 may be hinged, removably attached, or otherwise openable relative to the faceplate 306 such that the access door 308 has an open position and a closed position. In the open position, the first opening 314 is open such that the contents of the enclosed space 310 are accessible. In the closed position, the access door 308 covers the first opening 314 to prevent access to the contents of the enclosed space 310.

The components of the frame 300 are preferably attached to each other using secure screws and/or brackets such that the frame cannot be disassembled without at least first gaining access to the enclosed space 310.

In some cases, the frame 300 may include mounting supports, for example a bracket, shelf, or the like, to attach the secure container 102 to a wall or the like. Further, the secure container 102 may be located in a vehicle, for example a fire truck, ambulance, car, or the like; and in this case, the frame 300 may include mounting supports to mount the secure container 102 to the vehicle. Power can be provided to the secure container, if necessary, by hard wiring the container into the vehicle electrical system. Alternatively, a separate power source can be provided for the secure container, such as batteries or the like.

In other embodiments, there may be a secondary access point (not shown) to the secure container 102. In case, for example, the entry code for the container lock is lost, the container lock is malfunctioning, the secure container 102 loses power, or the like, the secondary access point may grant access to the enclosed space 310 to retrieve the receptacle key 114. The secondary access point may be, for example, a second locked door operable by a master key, a second locked door operable with a special screwdriver, a specialized RFID tag that opens the access door 308 or a second locked door, or the like.

Figure 4:
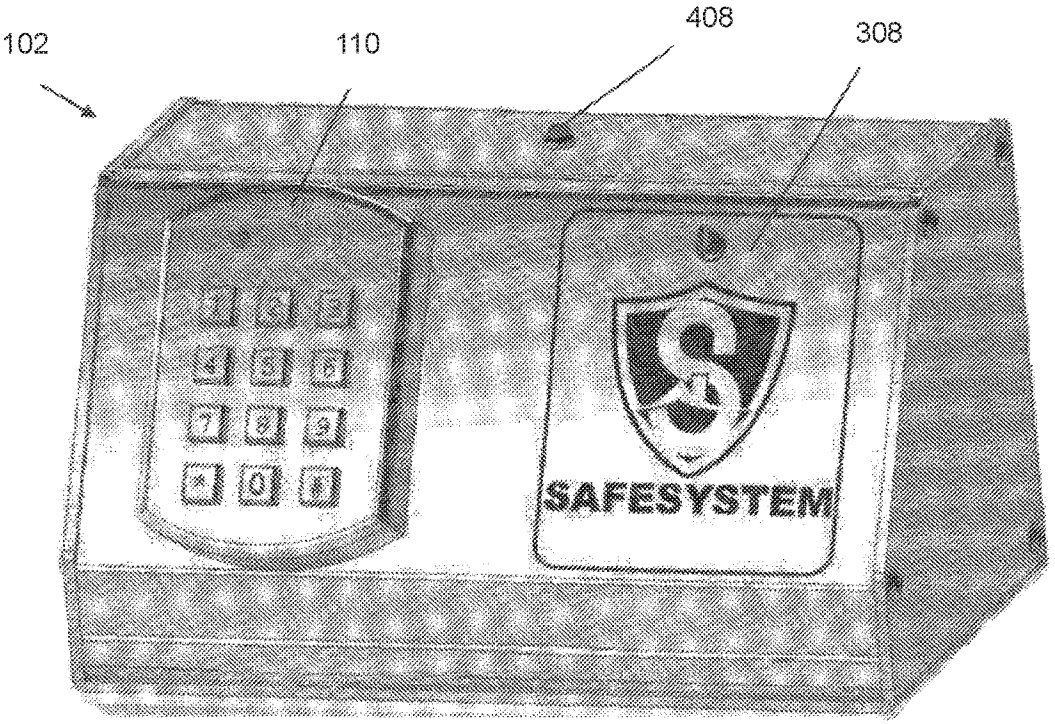
FIG. 4 illustrates a front view of the secure container with an access door closed.
Figure 5:
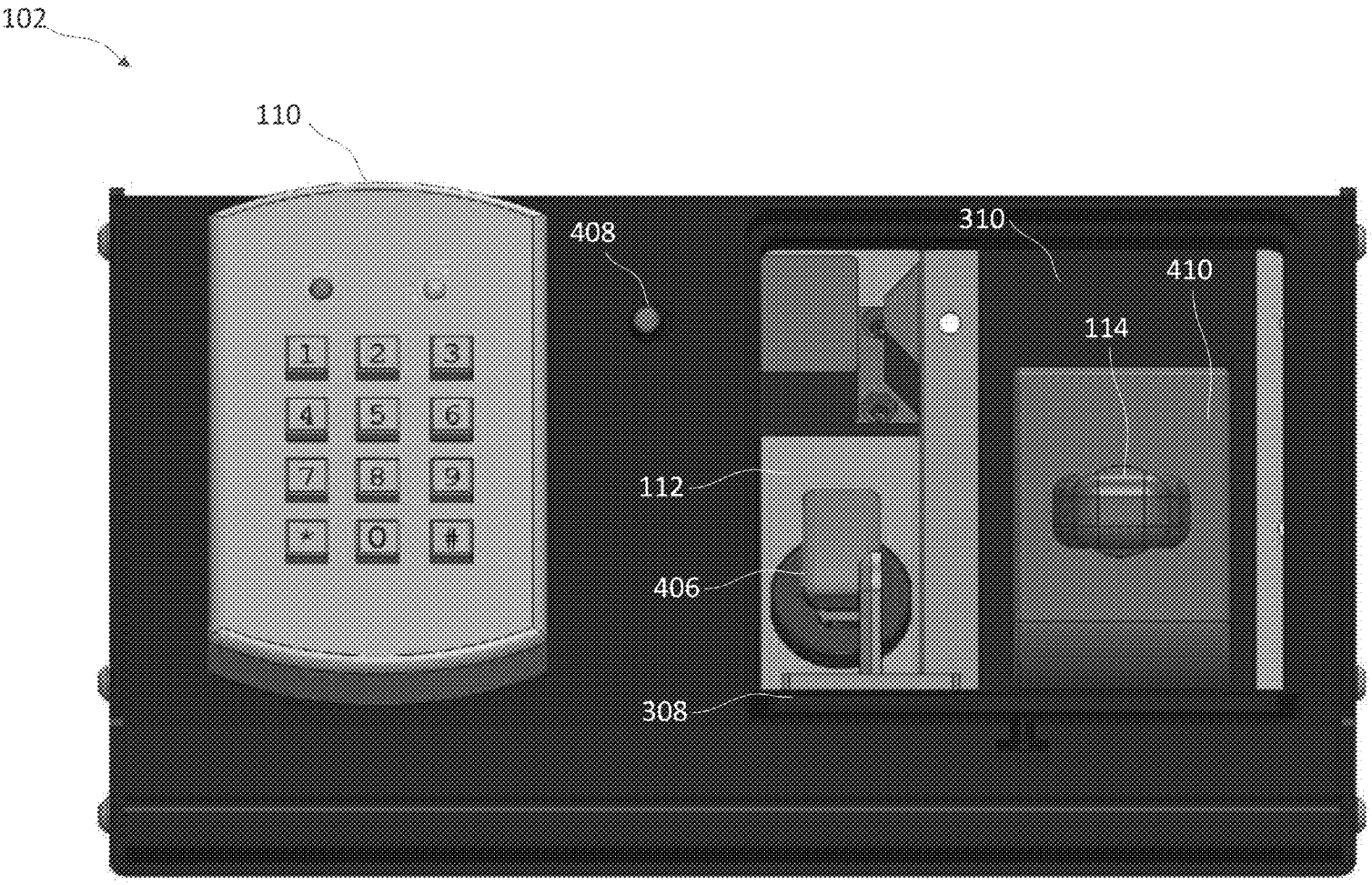
FIG. 5 illustrates a front view of the secure container with the access door open, showing an embodiment with an alarm trigger.

FIGS. 4 and 5 illustrate a front view of the secure container 102 with the access door 308 closed and open respectively.

In one embodiment, the secure container 102 includes a container lock 110 mounted to the front of the secure container, for example, a Linear AK-21 Digital Keypad Lock. In some cases, the correct entry code to the container lock 110 may be pre-programmed. In other cases, the correct entry code may be programmed by a user. In further embodiments, other suitable locks may be used; for example, a pin tumbler lock, RFID lock, facial/fingerprint recognition lock, lock incorporating a processor and liquid-crystal-display (LCD) screen, or the like.

Figure 6:
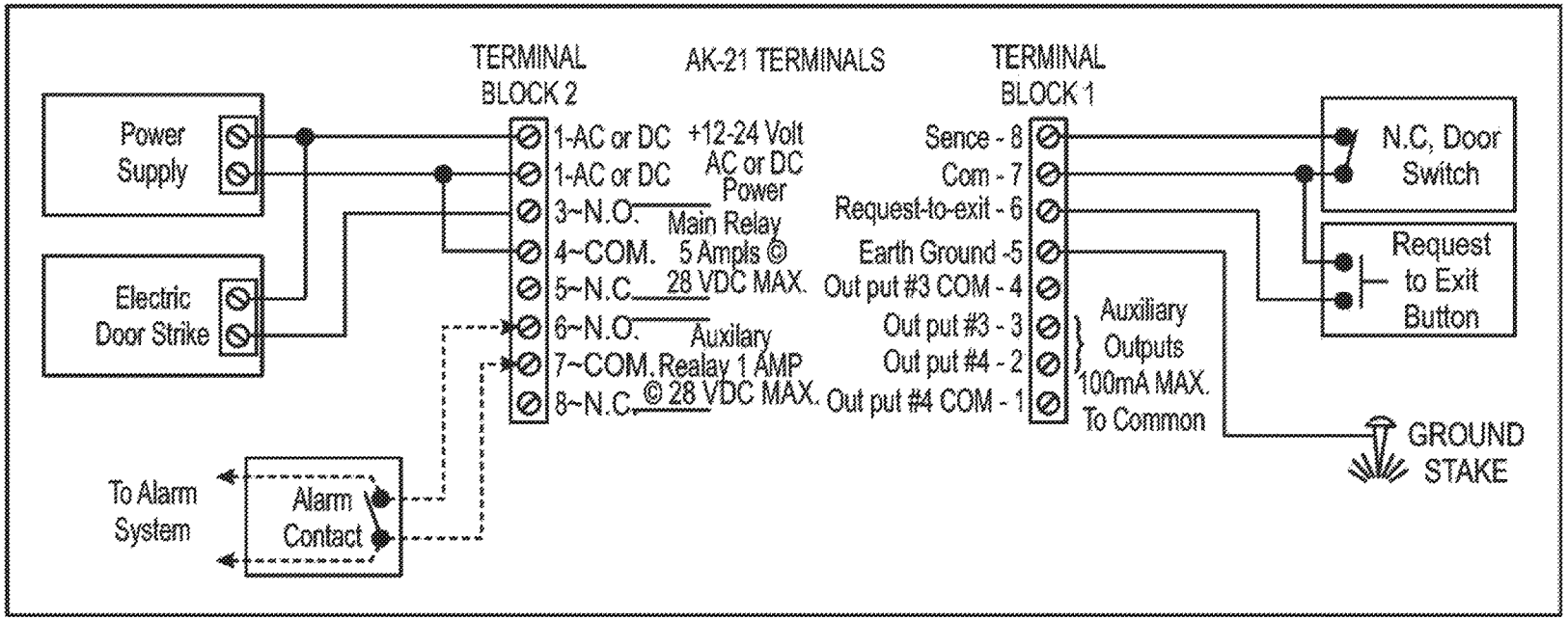
FIG. 6 illustrates an example electrical block diagram of the container lock.
Figure 7:
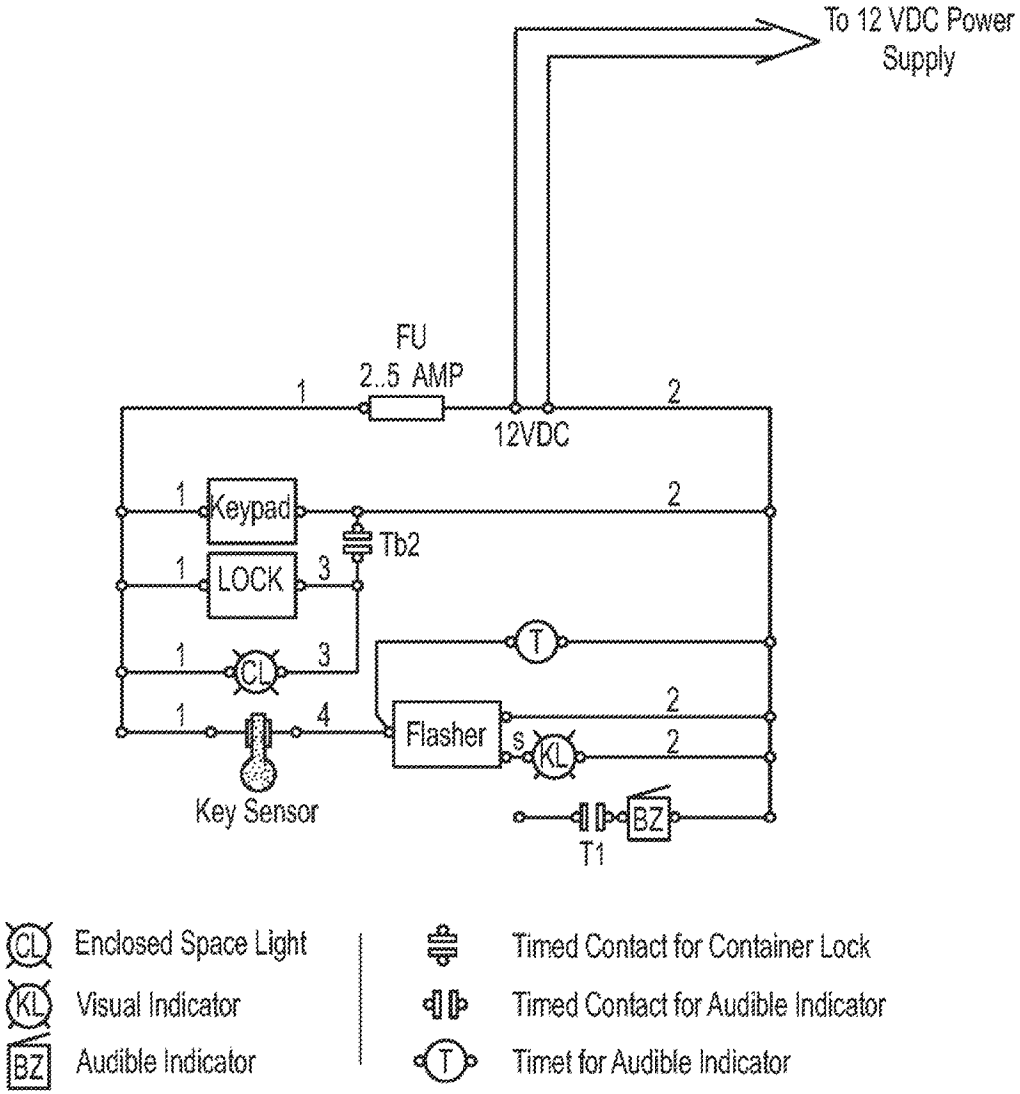
FIG. 7 illustrates an example electrical block diagram of the secure container.

FIGS. 6 and 7 illustrate example electrical block diagrams of the container lock 110 and secure container 102 respectively. Upon successful entry of the entry code into the container lock 110, the electric door strike receives a signal to open the access door 308. The access door 308 may then be opened revealing the contents of the enclosed space 310, as shown in FIG. 5.

In the example of FIGS. 4 and 5, the contents of the enclosed space 310 include an alarm unit 112 and the receptacle key 114. In some cases, the enclosed space 310 may include a light. The receptacle key 114 may be removed from a key holder 410 so that the receptacle key 114 may then be used to open the locking receptacle 104. When removing the receptacle key 114, the user may also remove the alarm trigger 406 from the alarm unit 112. Removal of the alarm trigger 406 activates the alarm unit 112 in order to alert users that the receptacle key 114 is not present inside the enclosed space 310. In some cases, there may be linkage (not shown) between the receptacle key 114 and the alarm trigger 406 such that both must be removed approximately together. The alert by the alarm unit 112 that the receptacle key 114 is not present may include a visual indicator 408, for example a light-emitting-diode (LED), an audible indicator (not shown), for example a buzzer, or the like. It is an intended advantage that the alarm unit 112 can provide reassurance that the receptacle key 114 will be returned to the secure container 102 after the receptacle key 114 is used to open the locking receptacle 104. In some cases, the visual indicator 408 and/or the audible indicator may be on a timer to cycle the indicator on and off periodically. In this way, the user will be notified and reminded if the user forgets to put the receptacle key 114 back into the secure container 102. In some cases, the alarm unit may prevent the access door from being closed if the receptacle key 114 and the alarm trigger 406 have not been returned. It is intended that where the secure container 102 travels with the user to the property, the alarm unit 112 can indicate to a user not to leave the property before retrieving and returning the receptacle key 114 to the secure container 102. Thus, substantially preventing the possibility of lost or forgotten receptacle keys 114.

Figure 16:
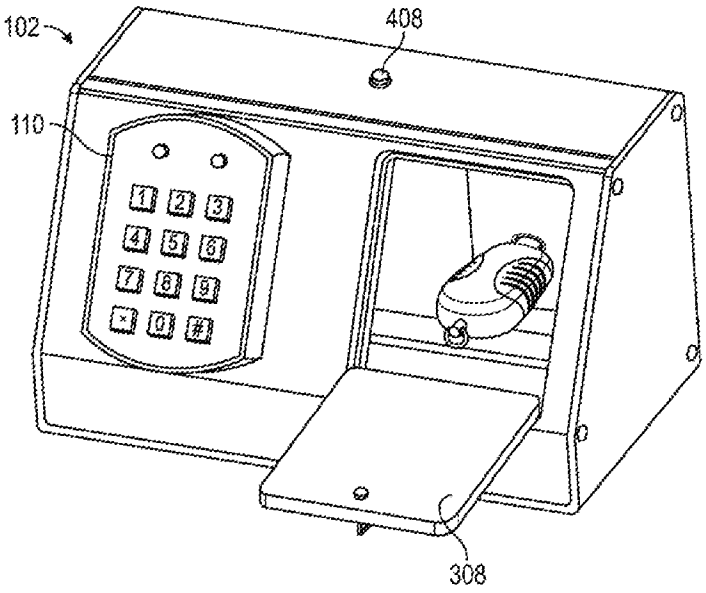
FIG. 16 illustrates a front view of the secure container with the access door open, showing an embodiment with an internal alarm trigger.

Other types of notifications and variations of triggering the alarm unit will be understood to be possible. For example, the alarm trigger may not be a separate physical component, but may be triggered internally, automatically upon removal of the receptacle key 114. FIG. 16 shows an illustration of an embodiment of the secure container 102 with an internal trigger without a physical external alarm trigger 406.

In an example, where the locking receptacle 104 stores property keys 122 for emergency responders such as firefighters, the secure container 102 may be mounted in the fire truck. When the firefighters arrive to respond to an emergency situation at a property, they unlock the secure container by disengaging the container lock 110. Upon receiving access to the enclosed space 310, the firefighters remove the receptacle key 114 and the alarm trigger 406. In some cases, there may be linkage (not shown) between the receptacle key 114 and the alarm trigger 406 such that both must be removed approximately together. The firefighters may then use the receptacle key 114 to open the locking receptacle 104 in order to retrieve the property key 122 and enter the property. As the alarm trigger 406 has been removed from the alarm unit 112, the alarm unit 112 will periodically alert the firefighters that the receptacle key 114 has yet to be returned. Thus, the firefighters will be reminded before they leave to retrieve the receptacle key 114 and not leave the receptacle key 114 at the property. Especially where the receptacle key 114 can open locking receptacles 104 for multiple properties, having the alarm unit 112 may increase security and reduce liability for the fire department by preventing a lost or forgotten receptacle key 114.

Depending on the application, there may be more than one receptacle key 114. In the above example, there may be a receptacle key 114 for each neighborhood of properties, for each street of properties, or the like. Having multiple receptacle keys 114 may help further limit liability if one of the receptacle keys should happen to go missing because the missing receptacle key will only affect a subset of properties. In some cases, the different receptacle keys 114 may be stored in the same secure container 102. In these cases, when one of the receptacle keys 114 is removed from the secure container 102, the alarm trigger 406 should also be triggered. In further cases, each of the different receptacle keys 114 may be stored in a separate secure container 102.

In some cases, the enclosed space 310 of the secure container 102 may store other articles along with the receptacle key 114. In the above example, the enclosed space 310 may include an extra set of keys for the fire truck or information on emergency procedures. In another example, where the secure container belongs to a real estate firm, the enclosed space 310 may contain private contact information and private details about the home owners.

In further embodiments, the receptacle key 114 may be tied into the alarm unit 112 such that removal of the receptacle key 114 from the secure container 102 activates the alarm unit 112. In these cases, the alarm trigger 406 may not be required. The receptacle key 114 may be tied into the alarm unit 112 by, for example, having a sensor connected to the alarm unit 112 that determines when the receptacle key 114 is removed from the key holder 410.

In some cases, there may be more than one type of locking receptacle 104, and likewise, more than one type of counterpart receptacle key 114. In an example, there may be a 'lower security' locking receptacle 104 and a 'higher security' locking receptacle 104. The lower security locking receptacle 104 may be used to store lower risk articles, for example property owner contact information sheets. The higher security locking receptacle 104 may be used to store higher risk articles, for example property keys 122. In this example, the lower security locking receptacle 104 may be a less secure type of key, for example a tubular key, and the higher security locking receptacle 104 may be a more secure type of key, for example an RFID key. As well, owing to the different levels of liability, the higher security receptacle key 114 may be stored in a secure container 102 while the lower security receptacle key 114 may be kept outside of a secure container 102.

In some instances, the secure entry system 100 of FIG. 1 may include remote activation as another layer of security. In these instances, the secure container 102 may include an activation unit 116. In other embodiments, the activation unit 116 may be a stand-alone entity. The activation unit 116 may be connected to an activator 106 via a network 108. The network 108 may be, for example, an Ethernet connection, a personal area network (PAN), a local-area-network (LAN), the Internet, a cellular network, or the like. The receptacle key 114 may be connected to the secure container 102 via the network 108. In further cases, the receptacle key 114 may be connected to the secure container 102 via a different network. In other cases, the receptacle key 114 may be directly connected to the activator 106 via the network 108 without requiring the secure container 102 as an intermediary.

In some cases, the receptacle key 114 may need to be inserted into the activation unit 116 in order to receive activation. In other cases, the receptacle key 114 may be connected to the activation unit 116 via the network 108. In further cases, the receptacle key 114 may be connected to the activation unit 116 via a separate network. In yet other cases, the receptacle key 114 may be directly connected to the activator 106 via the network 108 without requiring the activation unit 116 as an intermediary. In yet other cases, the system 100 may be connected to the network 108 via a separate intermediary device that has network connection capabilities; for example, a laptop, a cellular phone, or the like.

In the above instances, the receptacle key 114 is configured to have an activation identifier stored on a programmable memory. The activation unit 116 may be configured to read/write to the receptacle key 114 in order to change the status of the activation identifier. The receptacle lock 120 is correspondingly configured to read the status of the activation identifier and programmed to only open the locking receptacle 104 when the activation identifier is set to 'on'. When the activation identifier is set to 'off', the receptacle lock 120 will not open even if the receptacle lock 120 is engaged by the counterpart receptacle key 114.

The activation identifier may be set by the activator 106 via the activation unit 116. The activation identifier will normally be set to 'off' such that the receptacle key 114 will not engage the receptacle lock 120 until activated. In anticipation of using the receptacle key 114 to open the receptacle lock 120, a user may make a request to the activator 106 to activate the receptacle key 114 by setting the activation identifier to 'on'. The activator 106 may similarly set the activation identifier to 'off'. In some cases, the activation identifier may be set to 'off' automatically at the expiry of a predetermined timer, automatically after the receptacle key 114 opens the receptacle lock 120, or the like.

The activator 106 may be, for example, a person at a computer with authorization powers, a computer that can automatically analyze the source of the request to grant authorization, part of an emergency dispatch system, or the like. The user may make the activation request by, for example, placing a phone call with the activator 106, triggering an activation request switch on the secure container 102 or on the receptacle key 114, or the like. In other cases, where the activator 106 is part of an emergency dispatch system, the activation request may be sent automatically when the emergency responders are sent out to a call. Where there is more than one receptacle key 114, each receptacle key 114 may have a unique activation identifier such that the activator 106 can activate a specific receptacle key 114. In some cases, the activator 106 may receive data from the alarm unit 112 regarding whether the receptacle key 114 has been removed and/or returned to the secure container 102. It is intended that use of the activator 106 may provide a supplementary layer of security as lost or stolen receptacle keys 114 will not work without activation. As such, there may be less liability for users if they were to lose the receptacle key 114 as the receptacle key 114 would be unusable. For example, the receptacle key could have an RFID thereon that communicates with the activator or the secure container. A unique identifier system could be included to provide a further level of security.

Figure 8:
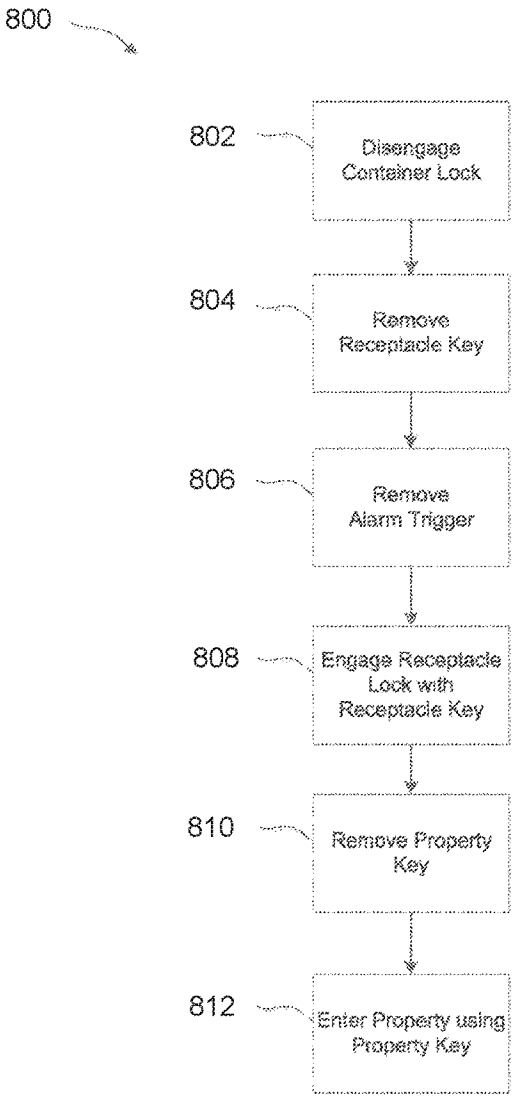
FIG. 8 is a flowchart for an embodiment of a method for secure entry.

FIG. 8 is a flowchart for an embodiment of a method for secure entry 800. At 802, a user disengages a container lock 110 located on a secure container 102. The container lock 110 may be, for example, a Linear AK-21 Digital Keypad Lock, a pin tumbler lock, RFID lock, facial/fingerprint recognition lock, lock incorporating a processor and liquid-crystal-display (LCD) screen, or the like. Upon disengaging the container lock 110, the access door 308 is openable and, at 804, the receptacle key 114 may be removed from the enclosed space 310. At 806, the alarm trigger 406 is also removed from the enclosed space 310 in order to active the alarm unit 112 or the alarm trigger is triggered internally. At 808, the user engages the receptacle lock 120 with the receptacle key 114 in order to open the locking receptacle 104. At 810, the user gains access to the opening 210 of the locking receptacle 104 where the user may remove the property key 122. In other cases, other articles along with, or instead of, the property key 122 may be retrieved by the user from the locking receptacle 104; for example, an emergency contact information sheet, a garage door opener, a parcel, or the like. At 812, the user may enter the property using the property key 122.

Figure 9:
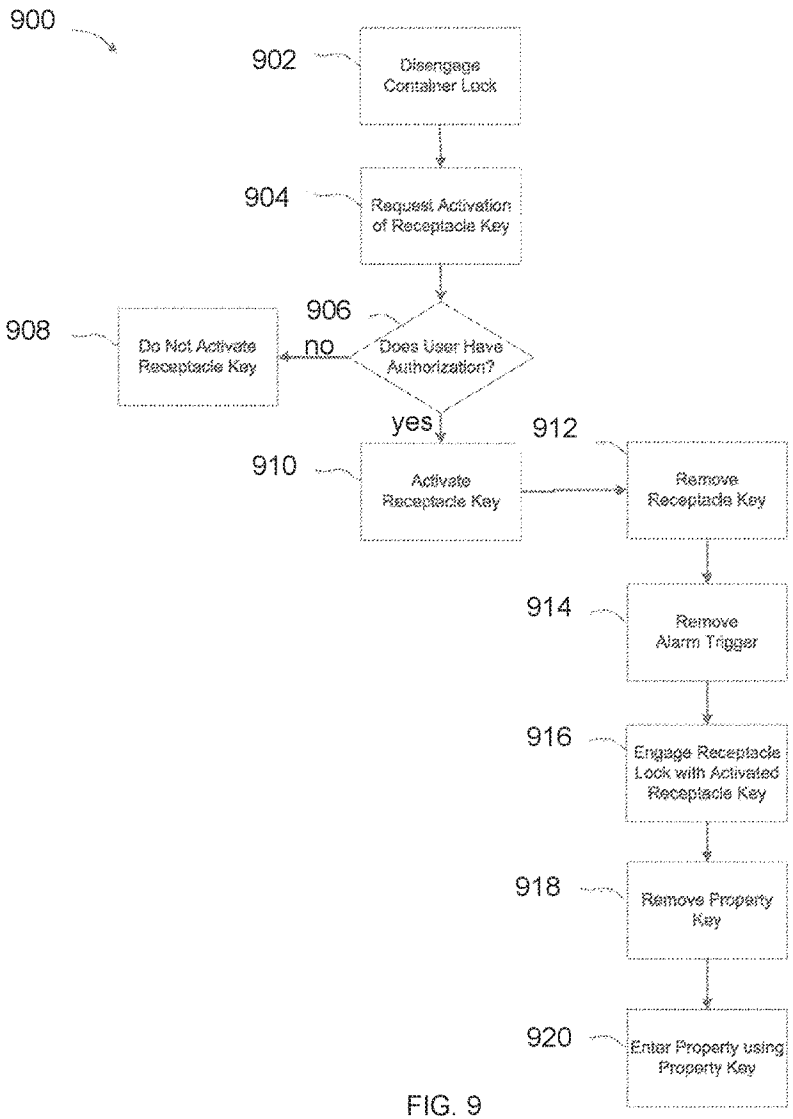
FIG. 9 is a flowchart for another embodiment of a method for secure entry.

FIG. 9 is a flowchart for another embodiment of a method for secure entry 900. At 902, a user disengages a container lock 110 located on a secure container 102. At 904, the user requests activation of the receptacle key 114 from the activator 106. The user may make the activation request by, for example, placing a phone call with the activator 106, triggering an activation request switch on the secure container 102 or on the receptacle key 114, or the like. At 906, the activator 106, manually or automatically, determines whether the user has authorization to use the receptacle key 114. If the activator 106 determines that the user is not authorized to gain access to the locking receptacle 104, at 908, the activator 106 does not activate the receptacle key 114. If the activator 106 determines that the user is authorized to gain access to the locking receptacle 104, at 910, the activator 106 activates the receptacle key 114. Upon disengaging the container lock 110 and receiving activation of the receptacle key 114, the access door 308 is openable and, at 912, the receptacle key 114 may be removed from the enclosed space 310. At 914, the alarm trigger 406 is also removed from the enclosed space 310 in order to active the alarm unit 112 or the alarm trigger is triggered internally. At 916, the user engages the receptacle lock 120 with the activated receptacle key 114 in order to open the locking receptacle 104. At 918, the user gains access to the opening 210 of the locking receptacle 104 where the user may remove the property key 122. In other cases, other articles along with, or instead of, the property key 122 may be retrieved by the user from the locking receptacle 104; for example, an emergency contact information sheet, a garage door opener, a parcel, or the like. At 920, the user may enter the property using the property key 122. In further cases, the activation of the receptacle key 114 may be prior to the disengagement of the container lock 110 (for example, when an emergency responder is travelling to the emergency), or after the receptacle key 114 is removed from the enclosed space 310 (for example, when the emergency responder is walking from the truck to the property).

Figure 10:
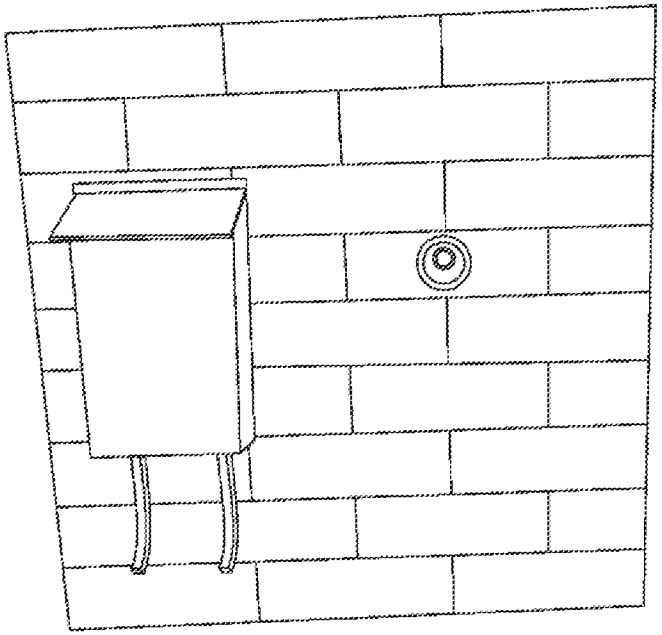
FIG. 10 illustrates an example mounting of a locking receptacle on the outside of a property.
Figure 11:
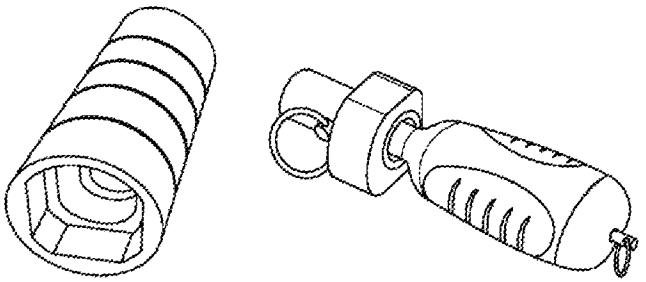
FIG. 11 illustrates an example electronic key inserted into the end of the locking receptacle.

An example embodiment of mounting of the locking receptacle is shown in FIG. 10. In this example, the locking receptacle is roughly 1½ inches in diameter and 4 inches long. It is installed on the outside of a property by drilling into the brick, siding, stone etc. The locking receptacle is recessed flush to the outside wall and houses a copy of the property key internally. The locking receptacle can be opened using a receptacle key such as an electronic key obtained from the secure container, for example an electronically programmable smart key, such as provided by Medeco Nexgen XT. An example electronic key inserted into the end of a locking receptacle is illustrated in FIG. 11. Such an electronic key can receive a signal from an activator such as via local dispatch or from an officer's cell phone, which can activate the key for a specific length of time. In one embodiment, the electronic key is locked in a secure container on a mobile platform that determines a key programming code based on a geographic position in real-time. The programming code provides the user with a secure and traceable method to gain access to a property, while at the same time still maintaining a secure environment for the property owners.

Figure 12:
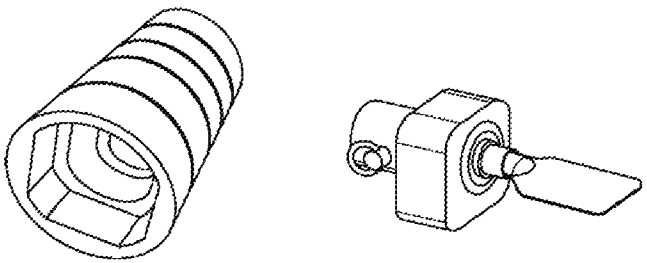
FIG. 12 illustrates an example manual key inserted into the end of the locking receptacle.

As an alternate embodiment, a traditional manual key can be used instead of the electronic key. FIG. 12 shows an example of a manual key inserted into the end of a locking receptacle, which could house a contact number inside for example. This could be a phone number or emergency contact person in case emergency crews need to gain access to the property or to at least inform the property owner that there is a problem at the property. The manual key to open this type of lock could be attached to the electronic key inside the secure container.

Figure 13:
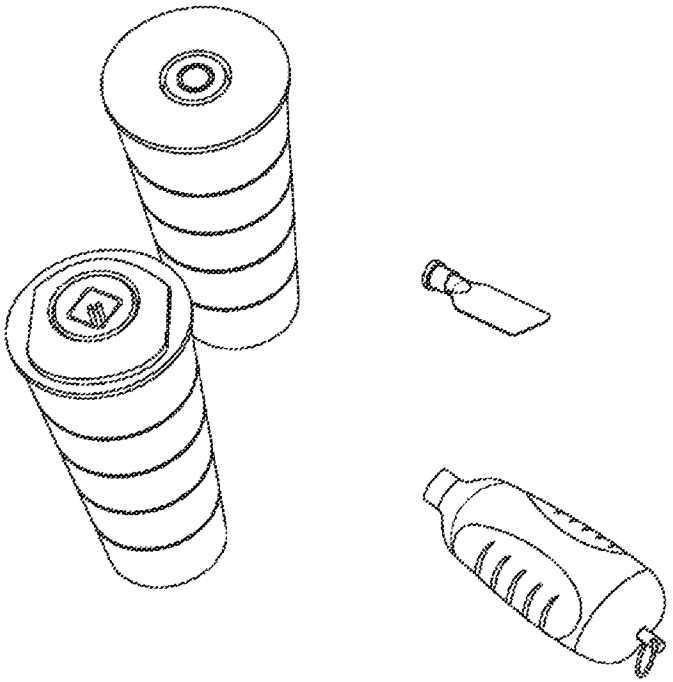
FIG. 13 shows two types of locking receptacles, each in a closed configuration next to their respective electronic and manual keys.

FIG. 13 shows both types of locking receptacles, each in a closed configuration next to the respective manual and electronic keys.

Figure 14:
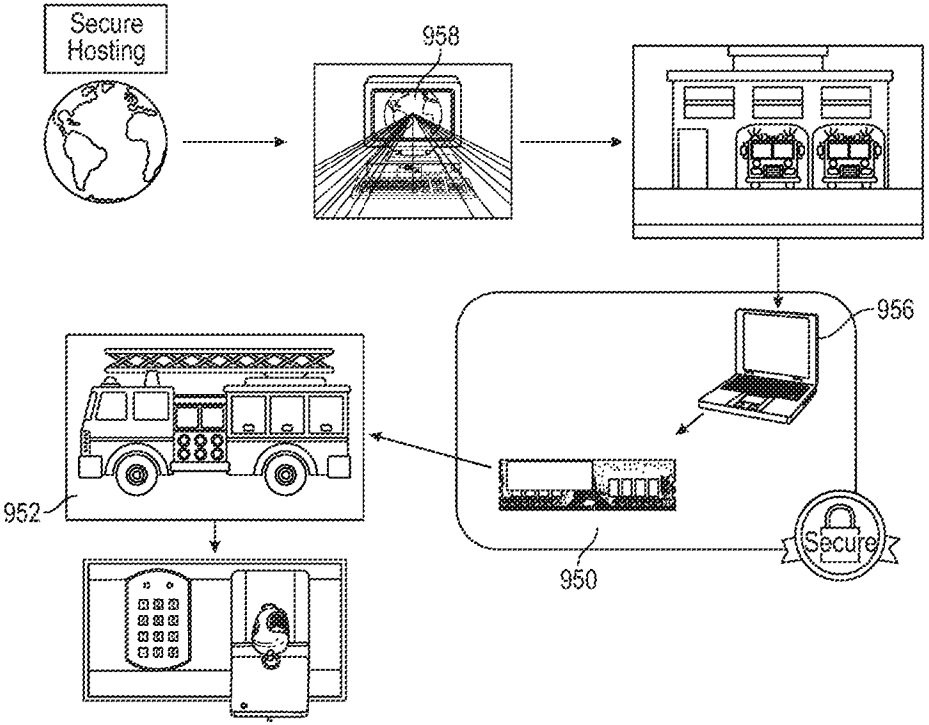
FIG. 14 illustrates a sample system configuration using an electronic key such as shown in FIG. 11.

FIG. 14 illustrates a sample system configuration using an electronic key such as shown in FIG. 11. The following discusses this sample system configuration.

A secure container interconnects with a vehicle ignition and external lighting systems to enable and activate a receptacle key. While en route a GPS constantly reviews the current position and accesses a local database containing a localized list of cylinder codes for locations enabled with lock boxes. The local database can be on an SD card in a binary format and encrypted with Advanced Encryption Standard (AES) keys. The local database can also be on any other suitable format using other suitable encryption standards.

The secure container in one embodiment can include a slot for the SD card (or other removable media), a connector to an interface with a smart security keypad having, for example, 4 digital outputs, and 2 digital inputs. An operator plugs an SD card 950 into the secure container on a firetruck 952, for example, to enable operation. The SD card can be periodically refreshed from any controlled laptop/PC 956 via an internet connection 958. Upon receiving an external signal from the smart keypad, the unit can use the supplied parameters to filter through a localized list of cylinder codes on the removable media (SD Card), and output a list of codes that are then downloaded to the receptacle key. The localized list of cylinder codes will preferably reside on removable media such as an SD card and will preferably be encrypted. Other telecommunication devices such as smart phones, smart watches, IPAD™s, IPOD™s, or the like can be used to refresh the SD card.

In a further related example, when the secure container is accessed, for example via a keypad, the nearest lock box codes are downloaded to the electronic key. This keypad access also records the user ID of the access code, the date and time of the access, the location (in GPS NMEA coordinates) and other operational parameters. This traceability information is then transmitted to a central office. Upon receipt of this information at the central office and authentication being granted, access is then allowed to the electronic key. Once the electronic key is removed, the alarm trigger circuitry activates and starts measuring the duration that the electronic key is not within the secure container. Replacing the electronic key, verification of the access code, and closing the secure container terminates the duration measurement and causes another communication with the central office. The communication terminates the activity report for that call providing the department with a report that contains various points of information, such as:

Operation data log
Date/time of start of call
Distance travelled to call
Time en route
User id of person gaining access to electronic key
Location of access
Access key codes downloaded
Time of keypad access
Time electronic key was removed
Duration electronic key was in service
Notifications prompting key replacement The present secure entry system in another aspect is able to provide multiple individual entry codes so that each emergency response attendant with approved access to their secure container could have their own access code to the secure container, thus creating accountability respecting the last person to access the container. In another embodiment, multiple levels of notification and alarm indications can be implemented. Each notification/alarm provides increased visibility for the need to replace the key. All elapsed time values can be configurable from the central office. The electronic key can include a built-in failsafe whereby it automatically loses access to all lock boxes after a fixed interval of 24 hours. Examples of alarm levels, indicators and elapsed time are shown in the below table:

| Alarm/ notification level | Indicators | Elapsed time (default) |
|---|---|---|
| 1 | Flashing light | 1 Hr |
| 2 | Flashing light and intermittent buzzer | 2 Hrs |
| 3 | Flashing light and constant buzzer | 4 Hrs |
| 4 | Flashing light, constant buzzer and SMS to central office | 8 Hrs |
| 5 | System shutdown and key deactivation from database | 24 Hrs |

In one case, audit information recorded in both the locking receptacle and electronic key shows a time-and-date stamped record of every event, including authorized accesses and unauthorized attempts.

During deployment, for example, the locking receptacle codes, access codes, GPS location, and other pertinent information can be recorded along with the quality of signal to ensure that no lockbox will be installed without an adequate signal for both GPS and cellular signals. This assists in avoiding signal 'canyoning' between buildings and ensuring two way communications with the central office and/or the secondary/backup facility. Canyoning is where the GPS signals bounce off adjacent buildings or other natural obstacles preventing an accurate location 'fix'.

Figure 15:
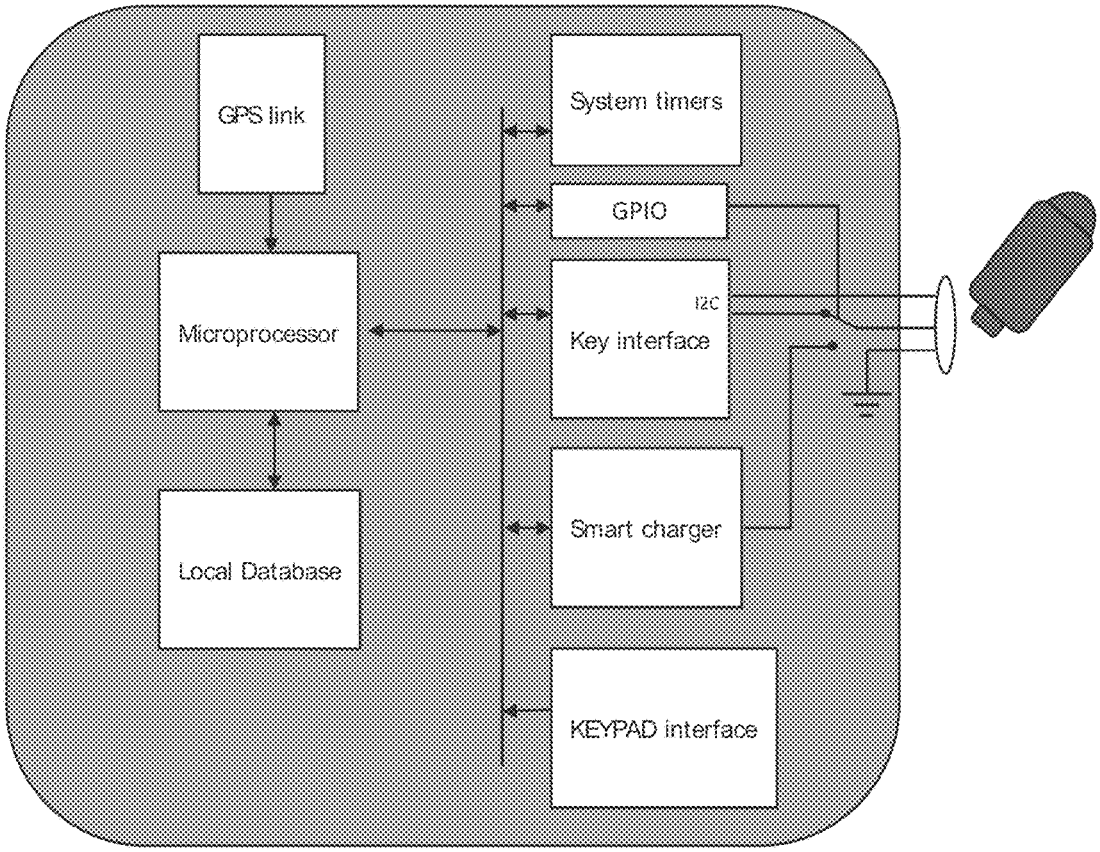
FIG. 15 shows a sample connection between a GPS link, local database at a central office or other location and the system including various system timers, a keypad interface and the electronic key having, for example, a general purpose input/output (GPIO), an interface and a smart charger, and a keypad interface.

FIG. 15 shows a sample connection between a GPS link, local database at a central office or other location and the system including various system timers, a keypad interface and an electronic key having, for example, a general purpose input/output (GPIO), an interface and a smart charger.

In one embodiment, the secure container is a small and portable stand-alone container. The secure container can accept a message (e.g. a formatted data packet) via a standard wired interface (for example, rs232/485, USB, I2C, SPI, or other suitable wired interface) that contains filter parameters. Preferably the secure container is operable in a wide range of temperatures. Preferably the secure container operates with 12 VDC switched power source, with backup power available.

In another embodiment of the present invention, the secure container includes a computer chip board that acknowledges all locking receptacles installed in both residential and commercial use as said EMS or non-emergency vehicle moves throughout an area. In this embodiment, a vehicle starts and sends a charge to the secure container. As the vehicle moves, a signal is sent from the secure container to all installed locking receptacles. As each locking receptacle comes within range of the secure container, the secure container can read and acknowledge the locking receptacle.

In a further related case, once the vehicle stops moving, the receptacle key inside the secure container can only open locking receptacles within a given range, for example 100 feet. For example, when the vehicle arrives at the destination and the secure container is opened, a GPS signal is sent to the electronic receptacle key to make the key "live" for a specified period of time. The distance from the secure container to the locking receptacle can be varied to be any reasonable distance, for example, 50 feet, 100 feet, 200 feet or more. Similarly, such a distance limitation for the electronic key is optional.

In another aspect, the present secure entry system can include a Tile GPS locator for each set of receptacle key(s). This miniature locator finds lost/misplaced keys at a scene within a given distance, for example 100 feet. The Tile also works within a community so that if said fire truck has lost keys and is outside the range for the key, other fire trucks that are closer can pick up the signal via a cell phone app or other similar sensor/monitoring mechanism.

Figure 17:
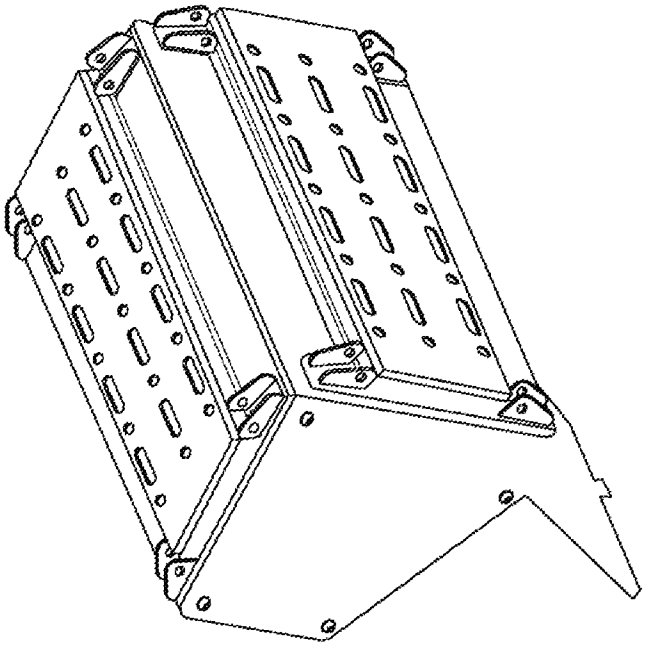
FIG. 17 illustrates an example mounting bracket for attaching the secure container to a vehicle.

FIG. 17 illustrates an example mounting bracket for attaching the secure container to a vehicle.

Various sample materials that can be used include a metal shell with a commercial punch key pad, charging system for an electronic key, a chip board and a lighting system.

It is intended that the systems and methods described herein may provide convenient and secure entry into one or more properties. Particularly where there are multiple properties, each with a different property key for entry, the systems and methods described herein can provide convenience to a user as the user may carry significantly less receptacle keys than if the user were to carry around all the property keys. There is also added convenience for the user as the user does not have to wait for a property owner to open the property, or, where there is an emergency in the property, the user does not have to break down the property's entryway. Further, it is recognized that the receptacle key is a high value object as it can be used to gain entry into one or more properties. Thus, it is an intended advantage that having the receptacle key stored in a secure container provides added security and reduces liability to the user. An alarm unit is intended to further provide added security by protecting against the possibility that the receptacle key is not returned to the secure container after entry to the locking receptacle. In some cases, further security measures for the receptacle key may be implemented by requiring the receptacle key to be activated prior to use; this ensures that if the receptacle key were to get lost or stolen, the receptacle key would be unusable. The system described herein provides a quick response to security threats, lost or stolen keys, or personnel changes without the added cost of changing locks and keys.

In the preceding description, for purposes of explanation, numerous details are set forth in order to provide a thorough understanding of the embodiments. However, it will be apparent to one skilled in the art that these specific details may not be required. In other instances, well-known electrical structures and circuits are shown in block diagram form in order not to obscure the understanding. For example, specific details are not provided as to whether aspects of the embodiments described herein are implemented as a software routine, hardware circuit, firmware, or a combination thereof.

Embodiments of the disclosure can be represented as a computer program product stored in a machine-readable medium (also referred to as a computer-readable medium, a processor-readable medium, or a computer usable medium having a computer-readable program code embodied therein). The machine-readable medium can be any suitable tangible, non-transitory medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the disclosure. Those of ordinary skill in the art will appreciate that other instructions and operations necessary to implement the described implementations can also be stored on the machine-readable medium. The instructions stored on the machine-readable medium can be executed by a processor or other suitable processing device, and can interface with circuitry to perform the described tasks.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

What is claimed is:

1. An apparatus for secured entry comprising:

a) an electronic and programmable receptacle key;

b) a secure container located within a vehicle housing the receptacle key when not in use;

c) a locking means for locking the secure container;

d) alarm means configured to trigger a timed alarm upon the removal of the receptacle key, which upon expiry, the receptacle key is disabled and unable to open locking receptacles;

e) the timed alarm resetting upon the placement of the receptacle key back within the secure container;

f) a miniature locator housed within the receptacle key to locate the receptacle key when not within the secure container;

g) an activation unit that uploads and transmits data to an action identifier of the receptacle key prior to its removal from the secure container;

h) at least one locking receptacle located on the exterior of the property for the secure storage of a property key; and, i) data on the use of the receptacle key to open locking receptacle is stored and transmitted to a central location upon the placement of the receptacle key within the secure container;

wherein the activation identifier of the receptacle key, upon its removal from the secure container housing, is programed to be active and to open the at least one locking receptacle within a defined range or neighborhood based on a GPS location of the vehicle, and for a defined period of time, thereby providing access to the property key and vital information stored within the locking receptacle.

2. The apparatus of claim 1 wherein the locking means includes a keypad and the locking means is unlocked upon input of an access code on the keypad.

3. The apparatus of claim 1 wherein various parameters are recorded upon the removal of the receptacle key from the secure container housing.

4. The apparatus of claim 3 wherein the various parameters are selected from the group consisting of a user ID, date of the input, time of the input, GPS location and combinations thereof.

5. The apparatus of claim 1 further comprising a removable media containing a list of cylinder codes.

6. The apparatus of claim 5 wherein at least a portion of the list of cylinder codes are transferred to the receptacle key within the housing.

7. The apparatus of claim 6 wherein the list of cylinder codes are geographically restricted.

8. The apparatus of claim 1 wherein the alarm means measures an amount of time that the receptacle key has been removed.

9. The apparatus of claim 1 wherein the timed alarm includes a notification selected from the group consisting of a flashing light, an intermittent buzzer, a constant buzzer, a message to a central office, and combinations thereof.

10. The apparatus of claim 9 wherein the timed alarm activates the notification after an elapsed time during which the receptacle key has been removed from the housing.

11. The apparatus of claim 10 wherein the alarm means deactivates the receptacle key after a further elapsed time during which the receptacle key has been removed from the housing.

12. The apparatus of claim 1 further comprising tracking means for locating the receptacle key outside of the housing.

13. The apparatus of claim 1 further comprising mounting means for mounting on a mobile platform.

14. The apparatus of claim 1 further comprising mounting means for mounting on a vehicle.

15. The apparatus of claim 1 further comprising a power source.

16. A method comprising:

a) a secure container continuously uploading locking receptacle data from communication with a network and GPS positioning; wherein the secure container is continuously uploading the locations of all locking receptacles located within a predetermined distance of the secure container's GPS positioning while a vehicle is in motion;

b) secure container transmitting the locking receptacle data to a receptacle key housed within the secure container;

c) retrieving a receptacle key from the secure container containing the locking receptacle data based on the GPS positioning of the secure container at the point of receptacle key retrieval;

d) triggering a timed alarm for return of the receptacle key; and, e) accessing a locking receptacle within a predetermined distance of the secure container's GPS positioning with the receptacle key;

wherein the return of the receptacle key to the secure container prior to the alarm is essential to the continued functioning of the receptacle key;

wherein the method further comprising the step of transferring at least a portion of a list of cylinder codes to the receptacle key within the housing, wherein the list of cylinder codes are geographically restricted; and including the step of tracking the receptacle key outside of the housing.

17. The method of claim 16 wherein the step of retrieving the receptacle key comprises inputting an access code to unlock the secure container.

18. The method of claim 17 further comprising the step of recording various parameters selected from the group consisting of a user ID, date of the input, time of the input, GPS location and combinations thereof.

19. The method of claim 18 further comprising the step of transmitting the various parameters to a central location.

20. The method of claim 16 wherein the step of triggering the timed alarm comprises the step of measuring an amount of time that the receptacle key has been removed.

21. The method of claim 16 further comprising the step of activating a notification after an elapsed time during which the receptacle key has been removed from the housing.

22. The method of claim 21 wherein the notification is selected from the group consisting of a flashing light, an intermittent buzzer, a constant buzzer, a message to a central office, and combinations thereof.

23. The method of claim 22 further comprising the step of deactivating the receptacle key after a further elapsed time during which the receptacle key has been removed from the housing.

24. The apparatus of claim 1 wherein the activation identifier unit can be configured to be rest on a predetermined time interval wherein parameters are updated, failing which, the activation unit deactivates the activation identifier of the receptacle key.

25. The apparatus of claim 24 wherein upon input of the access code, various parameters are recorded.

* * * * *